US005349753A

United States Patent [19]

Gaffney

[11] Patent Number: 5,349,753

[45] Date of Patent: Sep. 27, 1994

[54] ONE-HANDED KNIFE SYSTEM

[76] Inventor: Patrick Gaffney, R.R. 2, Box 722, Putnam, Vt. 05346

[21] Appl. No.: 64,771

[22] Filed: May 19, 1993

[51] Int. Cl.[5] ..... B26B 3/06; F41B 13/00; A44B 11/25

[52] U.S. Cl. ..... 30/155; 30/158; 30/160; 24/166

[58] Field of Search ..... 30/88, 151, 155, 156, 30/158, 160; 24/166, 660, 165

[56] References Cited

U.S. PATENT DOCUMENTS

| | | | |
|---|---|---|---|
| 502,962 | 8/1893 | Green | 24/660 |
| 1,947,405 | 11/1927 | Giesen | 30/160 |
| 2,194,430 | 5/1940 | Greve | 30/160 |
| 2,250,290 | 7/1941 | Berg | 30/160 |
| 2,416,277 | 2/1947 | Siegel | 30/158 |
| 2,839,831 | 6/1958 | Baer | 30/155 |
| 3,542,426 | 11/1970 | Radke | 24/165 |
| 4,312,128 | 1/1992 | Olsen | 30/157 |
| 4,502,194 | 3/1985 | Morris et al. | 24/166 |

*Primary Examiner*—Richard K. Seidel
*Assistant Examiner*—Paul M. Heyrana, Sr.
*Attorney, Agent, or Firm*—Joseph S. Iandiorio; Kirk Teska

[57] ABSTRACT

A one-handed knife system in which a knife having a blade instantly deployed by pulling on the heel section thereof includes a separable tether which separates under a force greater than the force required to deploy the blade.

12 Claims, 2 Drawing Sheets

ONE-HANDED KNIFE SYSTEM

FIELD OF INVENTION

This invention features a one-handed knife system including a knife and a separable tether which when pulled firmly deploys the blade of the knife and which, when pulled even harder, separates releasing the knife from the user's belt so that the blade can be easily deployed with one hand.

BACKGROUND OF INVENTION

Using a knife with a foldable or sliding blade is generally a two-handed operation, and most knives that are operable with one hand are illegal in many states.

One-handed operation is desirable for speed and/or safety for workers or sportsmen who often use knives and must quickly cut open boxes, cut line, and the like. Fixed blade knives are simply not well suited for this purpose in all cases. Pocket knives, attached to a key chain or the like, are useful to some extent in that they are readily available for use, but as stated above, they require two hands to deploy the blade and moreover generally offer no means to quickly separate the knife from the chain should use of the knife free of its attaching chain be desired.

SUMMARY OF INVENTION

It is therefore an object of this invention to provide a one-handed knife system.

It is a further object of this invention to provide a one-handed knife system which can be attached to a worker's belt, belt loop or clothing, or a machine or equipment, for example, and operated easily with one hand, and which can also be easily detached from the belt as needed, also using only one hand.

It is a further object of this invention to provide a one-handed knife system which is easy to manufacture and assemble and use.

This invention results from the realization that if a knife including a blade which is deployable by extending the heel section of the knife is modifiable to include a detachable belt tether affixed to the heel section, the tether can be made to detach from the knife under a force greater than it takes to deploy the blade, thereby allowing the knife to be opened with only one hand and further allowing the operator to detach the knife from his belt also with only one hand.

This invention features a one-handed knife system including a blade and extendable heel, rod, or bar means. The blade is automatically deployed by subjecting the extendable means to a first tensile force. A separable tether is attached to the heel, red, or bar and includes two sections. The first section is automatically released from the first section by application of a tensile force greater than the tensile force required to deploy the blade. The tether may include a web strap and a releasable clip releasably securing the first portion of the web strap to the second portion. The clip may include a female section and a male section receivable within the female section wherein the male section includes a tab having a biased portion and the female section includes a cavity for receiving the tab. The biased portion automatically releases the tab from the cavity upon the application of a tensile force greater than the tensile force required to deploy the blade of the knife.

The knife may include a blade which folds with respect to the knife and a tang with a cam follower. A rod attached at one end of the heel section includes a cam section proximate the cam follower of the blade for unfolding the blade when the heel section is extended. The heel section may include an orifice for receiving a ring which is a part of the tether. The other end of the tether includes a loop for affixing the tether to an article of clothing. Alternatively, the blade may include teeth and extend by means of a bar and gear configuration wherein the bar is extended and drives the knife from its case.

This invention also features a one-handed knife system including a knife with a blade and means for rapidly deploying the blade, and also a separable tether including a first portion affixed to the means for deploying, a second portion, and means for releasably securing the first portion to the second portion.

DISCLOSURE OF PREFERRED EMBODIMENT

Other objects, features and advantages will occur to those skilled in the art from the following description of a preferred embodiment and the accompanying drawings, in which.

Figure 6:
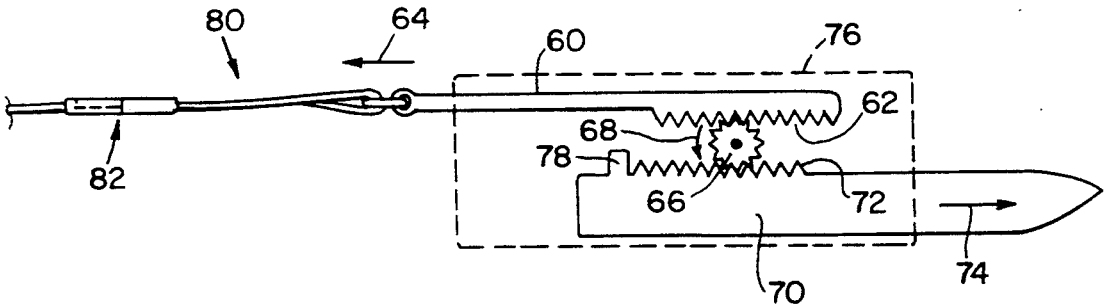

FIG. 6 is a schematic diagram of another embodiment of a one handed knife system according to this invention The one-handed knife system of this invention includes a knife with an extendable heel section and means for deploying the blade by subjecting the heel section to a first tensile force. A releasable tether is affixed to the heel section and detaches under a second tensile force greater than the tensile force required to deploy the blade.

This allows the knife to be readily at hand since the tether can be affixed to the user's belt, belt loop, tool box, or even to nearby equipment or fixtures. When the user needs to open the knife, he simply pulls the knife away from whatever the tether is attached to and the blade automatically opens. When the user needs to freely use the knife, he merely tugs on the knife with a slightly greater force and the tether releases. In this way, the knife is operated with one hand and the tether also detaches from the knife with one hand, thereby overcoming the disadvantages of prior art pocket knives and the like.

One-handed knife system 10, FIG. 1, of this invention includes knife 12 with a folding blade-14 as well as extendable heel section 16, the operation of which is further explained with reference to FIG. 5. By holding knife casing 18 with one hand and using the other hand to pull the heel section in the direction shown by arrow 20, blade 14 is deployed for cutting operations.

In this invention, however, only one hand is required to deploy blade 14. This is because heel section 16 is modified with orifice 22 through which ring 24 is deployed. Then, separable tether 26 is affixed to ring 24. Tether 26 includes clip 28, more particularly described with reference to FIGS. 3 and 4. In this way, if loop 30 of tether 26 is affixed to the operator's belt, she can use one hand to grasp the knife casing 18 and pull knife 12 away from her body, thereby automatically unfolding blade 14 for use. But, as explained below, if the operator then pulls even harder, clip 28 will release and the operator is then free to use knife 12 without it being attached by tether 26 to her belt. So, the operator can deploy blade 14 with one hand and use knife 12 while it is attached to the body, or, alternatively, can both deploy blade 14 and detach knife 12 from the body by using a slightly greater force when pulling knife 12 away from the body.

Figure 2:
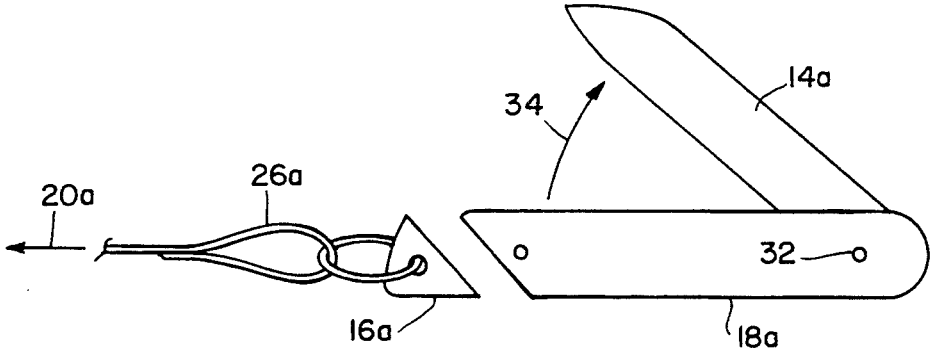
FIG. 2 is a schematic diagram similar to FIG. 1 showing the blade of the knife unfolding.

Blade 14*a*, FIG. 2, rotates about pivot 32 in case 18*a* and swings upwardly as shown by arrow 34 when heel section 16*a* is extended in the direction shown by arrow 20*a* by pulling on strap 26*a*.

Figure 3:
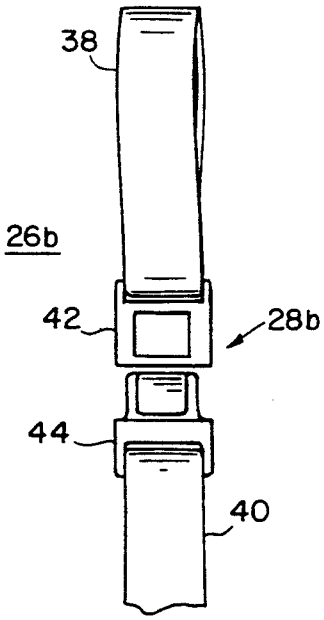
FIG. 3 is a partial schematic diagram of the separable tether shown in FIG. 1.

Tether 26*b*, FIG. 3, includes two sections 38 and 40 and clip 28*b* therebetween. Section 38 includes female portion 42 of clip 28*b*; section 40 includes male portion 44 of clip 28*b*. Female section 42*a*, FIG. 4, includes channel 50 for receiving tab 52 of male section 44*a*. Tab 52 includes biased portion 54 which bends down when it is slid into channel 50 and then springs up in cutout 56, releasing locking male section 44*a* within female section 42*a*. A sufficient amount of tension, however, will drive biased portion 54 downward thereby releasing male section 44*a* from female section 42*a*. Alternatively, biased portion 54 can be manually bent down to release male section 44*a* from female section 42*a*.

Figure 1:
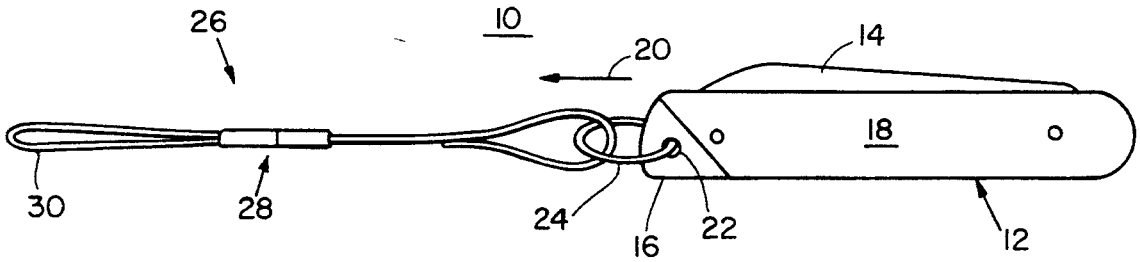
FIG. 1 is a schematic diagram of the one-handed knife system of this invention.

Other types of clips may be used, but it was empirically found that this particular type of clip inherently required a release tension which was sufficiently greater than the force required to deploy the blade of the knife, thereby assuring that tether 26, FIG. 1, was not released inadvertently. Still, clip 28 should not require too much of a jolt to separate tether 26 else the effect of being able to release knife 12 from one's belt or the like with one hand will be defeated.

Knife 12 operates as follows. Rod 60, FIG. 5, is attached to heel section 16*b* and extends the length of case 18*b* shown in phantom. On the other end, rod 60 includes cam 62. Tang 64 of blade 14*b* includes cam follower 66 and ridge 68. In operation, when heel section 16*b* is extended away from case 18*b*, ridge 70 of cam 62 strikes ridge 68 of cam follower 66, which begins lifting and rotating blade 14*b*. Then, cam follower 66 is positioned in and is rotated by cam 62, further deploying blade 14*b* as heel section 16*b* is further extended until blade 14 releasably locks in place for use. Folding blade 14*b* back into case 18*b* is accomplished by pushing heel section 16*b* back against case 18*b*.

Figure 4:
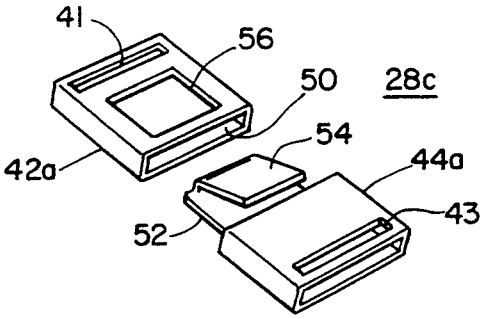
FIG. 4 is a more detailed schematic view of the clip employed with the tether of FIG. 3.

In a preferred embodiment, tether 26, FIG. 1, includes a nylon web strap material sewn over ring 24 and through slots 41 and 43, FIG. 4, of clip 28*c*. Loop 30 is formed so that tether 26 can be attached to a belt as explained above. Other types of fabric, or even chain, or cord, or a less flexible tether of metal, for example, may serve equally well as appropriate material for a tether, and other types of clips and ring combinations are within the scope of this invention.

Figure 5:
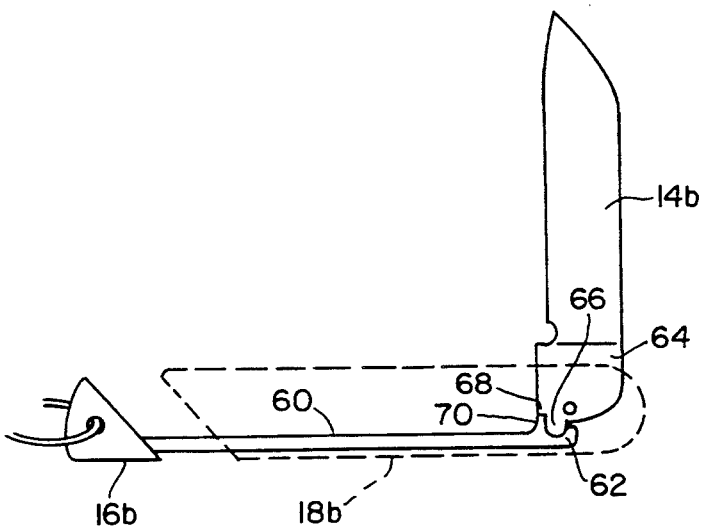
FIG. 5 is a more detailed schematic diagram of the knife of FIG. 1.

Moreover, equivalent means for deploying the knife blade other than the camfollower configuration shown in FIG. 5 are within the scope of this invention. For example, extendable bar 60, FIG. 6 includes teeth 62 so that when bar 60 is pulled in the direction shown by arrow 64, gear 66 is driven in the direction shown by arrow 68 which in turn deploys blade 70, having teeth 72, in the direction of arrow 74. Pushing rod 60, of course, returns blade 70 to its stored position within the knife case 76 shown in phantom. When gear 66 reaches step 78 on blade 70, a force applied to tether 80 causes clip 82 to disengage. Clip 82, as discussed above, should be designed such that it disengages at a force greater than the force required to drive blade 70 out of case 76 by pulling on rod 60.

Therefore, although specific features of this invention are shown in some drawings and not others, this is for convenience only as each feature may be combined with any or all of the other features in accordance with the invention.

And, other embodiments will occur to those skilled in the art and are within the following claims:

What is claimed is:

1. A one-handed knife system comprising:

a knife including a blade;

means for deploying said blade including extendable means for deploying said blade upon application of a first tensile force to said extendible means;

a separable tether including a first portion attached to said extendable means and a second portion, and means for automatically separating said second portion from said first portion upon application of a second tensile force to said tether greater than said first tensile force and for maintaining said second portion in contact with said first portion upon application of said first tensile force to said tether for allowing said blade to be deployed and for separating the tether with one hand.

2. The one-handed knife system of claim 1 in which said means for separating includes a releasable clip releasably securing said first portion to said second portion.

3. The one-handed knife system of claim 2 in which said clip includes a female section and a male section receivable within said female section.

4. The one-handed knife system of claim 3 in which said male section includes a tab having a biased portion, and said female section includes a cavity for receiving said tab.

5. The one-handed knife system of claim 4 in which said biased portion automatically releases said tab from said cavity upon application of said second tensile force.

6. The one-handed knife system of claim 1 in which said blade folds with respect to said knife and includes a tang with a cam follower.

7. The one-handed knife system of claim 6 in which said extendable means includes a heel section of the knife and said means for deploying includes a rod attached at one end to said heel section and including a cam section proximate the cam follower of said blade for unfolding said blade when said heel section is extended.

8. The one-handed knife system of claim 1 in which said extendable means includes a bar having teeth.

9. The one-handed knife system of claim 8 in which said means for deploying said blade includes teeth on said blade and a gear for driving said blade when said bar is subject to said first tensile force.

10. The one-handed knife system of claim 1 in which said extendable means includes an orifice therethrough.

11. The one-handed knife system of claim 1 in which said tether includes a web strap and a releasable clip.

12. The one-handed knife system of claim 1 in which said second portion of said tether includes means for affixing said tether to an article of clothing.

* * * * *